United States Patent [19]

Kanno

[11] Patent Number: 4,504,056

[45] Date of Patent: Mar. 12, 1985

[54] TOY HAVING PLAYING SURFACE WITH ROTATING MEMBER LOCATED THEREON

[75] Inventor: Hideyuki Kanno, Tokyo, Japan

[73] Assignee: Tomy Kogyo Co., Inc., Tokyo, Japan

[21] Appl. No.: 433,030

[22] Filed: Oct. 6, 1982

[30] Foreign Application Priority Data

Oct. 13, 1981 [JP] Japan ..... 56-151884

[51] Int. Cl.[3] ..... A63F 7/06; A63F 7/38

[52] U.S. Cl. ..... 273/88; 273/110; 446/309

[58] Field of Search ..... 273/89, 88, 126, 109, 273/110, 85 A, 85 E, 39, 38, 37; 46/202, 216; 194/36; 446/444, 353–355, 308, 309

[56] References Cited

U.S. PATENT DOCUMENTS

| | | | |
|---|---|---|---|
| 589,724 | 9/1897 | Hess | 104/36 |
| 2,642,290 | 6/1953 | Moloney et al. | 273/118 |
| 3,576,325 | 4/1971 | Naturale | 273/89 |
| 3,693,291 | 9/1972 | Aoki | 46/202 |
| 3,817,529 | 6/1974 | Dobbins | 273/126 R |
| 3,985,358 | 10/1976 | Hamano | 273/89 |

FOREIGN PATENT DOCUMENTS

| | | | |
|---|---|---|---|
| 1099139 | 3/1955 | France | 46/202 |

OTHER PUBLICATIONS

Tomy 1982 Catalog, p. 47, Strolling Bowling; Goof Around Golf.

*Primary Examiner*—Paul E. Shapiro

*Attorney, Agent, or Firm*—K. H. Boswell; Edward D. O'Brian

[57] ABSTRACT

For use with a self-propelled object, a toy can be formed having a housing with a playing surface located thereon. The playing surface includes a circular depression having a member rotatably mounted in the circular depression and capable of rotating in the circular depression. An element and gear train are associated with the member to rotate the member in response to movement of the element. The member includes a surface which is in alignment with the playing surface such that the self-propelled object can be located on the playing surface and directed toward the member. When the object moves itself onto the member, the member is rotated, allowing the object to move off of the member in a different orientation with respect to the playing surface. A retaining rib is formed on the playing surface adjacent to the periphery of the rotatable member and partially surrounding it to inhibit movement of the object. Scoring depressions deep enough to retain the object are formed in the playing surface. A score board is located on the playing surface for indicating progress of the game.

8 Claims, 5 Drawing Figures

FIG. 1
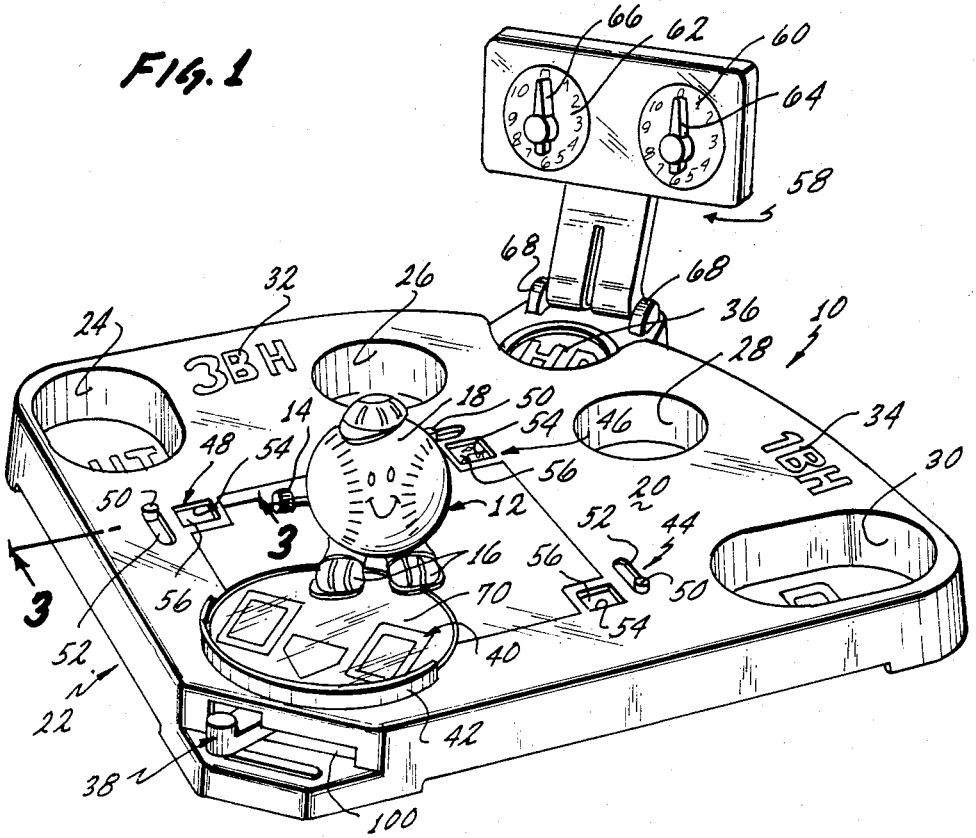
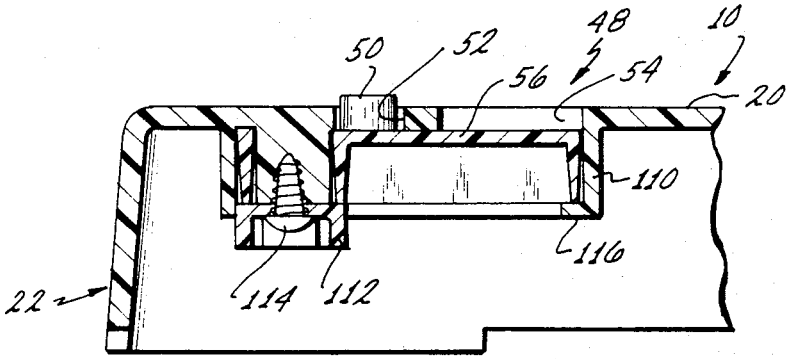
FIG. 3

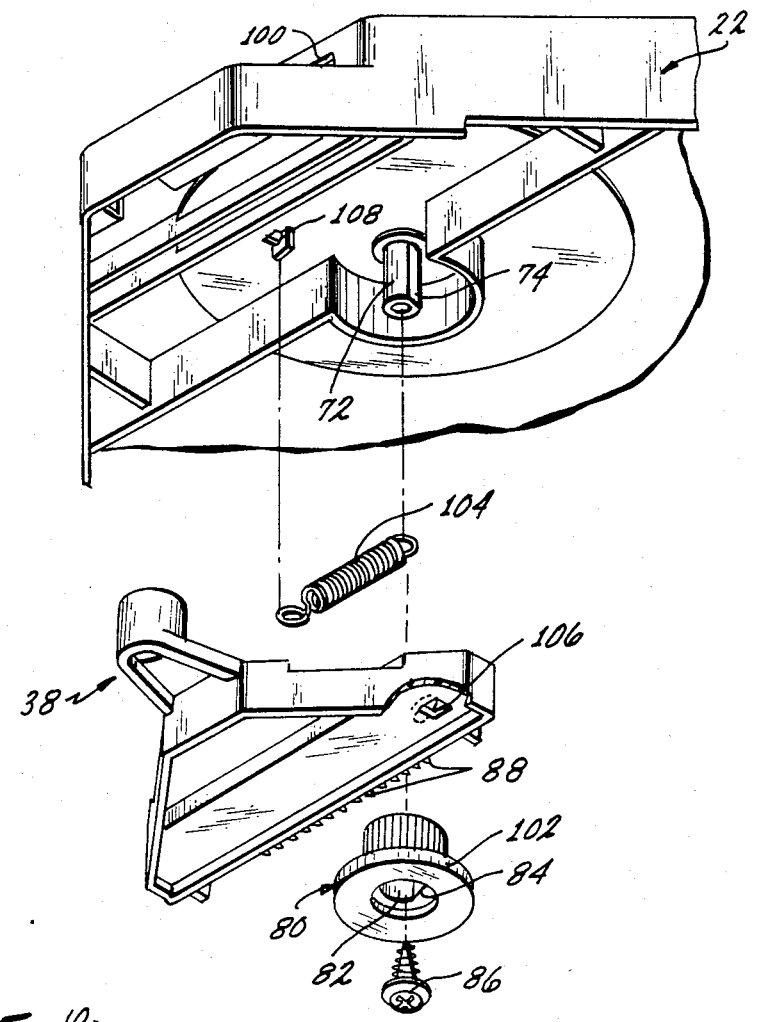
FIG. 4
FIG. 5
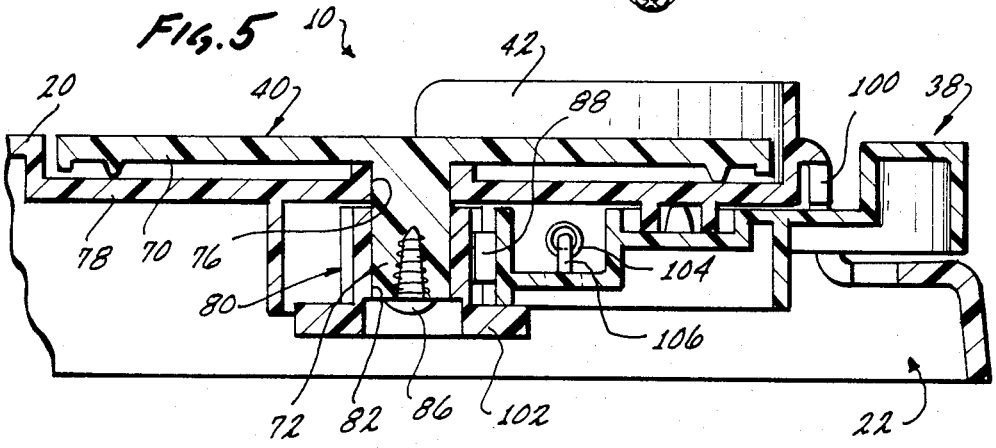

TOY HAVING PLAYING SURFACE WITH ROTATING MEMBER LOCATED THEREON

BACKGROUND OF THE INVENTION

This invention is directed to a toy which is used in conjunction with a self-propelled object. The toy includes a playing surface which can be used to re-direct the direction of movement of the object on the toy. Preferredly the playing surface is rotatably mounted on the toy such that the direction of movement of the object can be rotary displaced.

In U.S. application Ser. No. 198,799, a small toy object shaped as a ball and having feet projecting from the bottom thereof is disclosed. As described in the patent application, this object is capable of moving in somewhat of an erratic manner in a generally forward direction in a hopping-like motion. The toy so described in that referred to patent application is sold commercially and constitutes part of a toy known as Strolling Bowling TM. In this toy, the ball-like object is depicted as a bowling ball. A similar toy incorporates a similar ball-like object which has as its outside motif the motif of a golf ball. This toy is sold under the name Goof Around Golf TM. The ball-like object in the Goof Around Golf TM toy also moves in an erratic, hopping-like motion.

The erratic, hopping-like motion of the ball-like objects discussed in the previous paragraph is entertaining and interesting to watch. Because the objects move in a hopping-like motion, it is somewhat unpredictable as to exactly what path they will travel in moving over a surface. This lends interest and amusement to their use.

In both the Strolling Bowling TM and Goof Around Golf TM toys noted above, once the spring motor in the ball-like object has been wound and the ball-like object released on to a playing surface, it then negotiates that playing surface without further input from the user of the toy. Its movement on the playing surface is totally determined by the erratic, or random-like hopping movement which the object exhibits.

U.S. Pat. No. 3,693,291 describes a toy which is essentailly depicted as a city block having buildings with intersections and the like between the buildings. Located at strategic points on a playing surface are a number of cylinder like objects which can be raised by depressing a button attached to the toy. A self-propelled vehicle having a rotating disk on its bottom surface is made to travel over the surface of the toy. When the vehicle becomes located over one of the cylinders, the button can be depressed with the cylinder raising underneath the vehicle and catching under the spinning disk located on the bottom of the vehicle. This lifts the driving wheels of the vehicle free, such that the vehicle is no longer forwardly propelled. However, the spinning disk on the bottom of the vehicle engages the surface of the cylindrical member and rotates thereon, such that when the button is released and the cylindrical member descends back down into the playing surface, the object then becomes reoriented in a different direction on the playing surface and continues its travels under the power of its driving wheels.

It is considered that, because of the novel play value incorporated into the ball-like objects of the Goof Around Golf TM and Strolling Bowling TM type toys, additional toys incorporating these objects would provide for interesting and stimulating play. It is further considered that the idea expressed in U.S. Pat. No. 3,693,291, wherein the direction of a self-propelled toy can be changed, also could provide for stimulating play value, if incorporated into other toys. Thus, it is believed that a toy based on the erratic, hopping-like motions of the ball-like objects of the Goof Around Golf TM and Strolling Bowling TM toys, coupled with a direction changing mechanism would serve as an interesting, entertaining and delightful toy. The direction changing mechanism, however, disclosed in U.S. Pat. No. 3,693,291, is unsuitable for use in the ball-like toys disclosed above which move in hopping-like motions. The direction changing mechanism of U.S. Pat. No. 3,693,291 incorporates the noted turning disk, which requires that the bottom of the self-propelled vehicle, essentially the area directly below its center of gravity, be unencumbered, such that the rotating disk can be located at this position. This is an impossible reality with respect to the ball-like objects as described above which move in a hopping-like motion, because they require that their center of gravity be located over pedestal-like supports which are movable with respect to the main body to produce the hopping-like motion. As such, the direction changing motion of U.S. Pat. No. 3,693,291 cannot be incorporated with the ball-like objects which move in a hopping-like motion of the class described above.

BRIEF DESCRIPTION OF THE INVENTION

In view of the above discussion, it is a broad object of this invention to provide a toy which can be utilized in association with objects capable of propelling themselves across a surface, preferredly in a hopping-like motion, wherein the toy provides means for changing the direction of travel of said object. It is a further object to provide a toy which is both interesting and enjoyable in its use, but is so constructed such that it is capable of being produced in an economical manner and thus be economically available to the consumer, while still employing certain engineering and manufacturing principles rendering it susceptible to a long and useful lifetime.

These and other objects, as will become evident from the remainder of this specification, are achieved in combination with a self-propelled object a toy which comprises: a housing having a playing surface, said playing surface including a discontinuity located therein; a member rotatably mounted on said housing within said discontinuity, said member including a surface, said member surface being aligned with said playing surface and rotatable with respect to said playing surface as said member rotates; means located on said housing to rotate said member such that said object can move over said playing surface toward and on to said member surface followed by rotation of said member while said object is located on said member surface to rotary reposition said member surface with respect to said playing surface prior to movement of said object off of said member surface back on to said playing surface.

In the preferred embodiment of the invention, the discontinuity in the playing surface would comprise a circular depression formed in that playing surface, with the member being sized and shaped to fit into this circular depression such that the member surface and the playing surface are aligned with one another. In addition thereto, a retaining means can be positioned on the playing surface in association with the circular depression around a portion of the periphery of the circular depression such that the retaining means would be capable of inhibiting the movement of the object if the object abutted against the retaining means, and most specifically, the retaining means would be capable of holding the object on to the member as the member is rotated.

In the preferred form of the invention, the object would be capable of moving over the playing surface and the member surface in a hopping-like motion. Additionally, scoring means could be provided on the playing surface with at least one of the scoring means comprising a scoring depression formed in the playing surface. The scoring depression would be sized and shaped such that it would be capable of containing and retaining the object if the object, in moving over the playing surface, encountered the scoring depression and moved into the scoring depression. It is further preferred to include an indicating means located on the playing surface and capable of indicating the outcome of a game utilized in playing with the toy and the object.

Preferredly, the means to rotate the member would comprise a rack and pinion mounted in association with the member and in association with the movable element mounted on the housing. Movement of the movable element would be transferred to the rack and pinion to rotate the member. Preferredly, the pinion would be mounted on the member and the rack would be attached to the element, such that movement of the element moved the rack, which in turn moved the pinion to rotate the member. Preferredly, the element would be slidably mounted on the housing and would include a biasing means to bias it toward an initial or start position, such that both the element and the member would be biased toward an initial position.

BRIEF DESCRIPTION OF THE DRAWINGS

This invention will be better understood when taken in conjunction with the drawings wherein:

FIG. 1 is an oblique view showing the toy and the hopping object as they would appear during play;

FIG. 3 is a side elevational view in section about the line 3—3 of FIG. 1;

FIG. 4 is an exploded view of certain portions of the invention as seen in FIG. 2; and FIG. 5 is a side elevational end view about the line 5—5 of FIG. 1.

Figure 2:
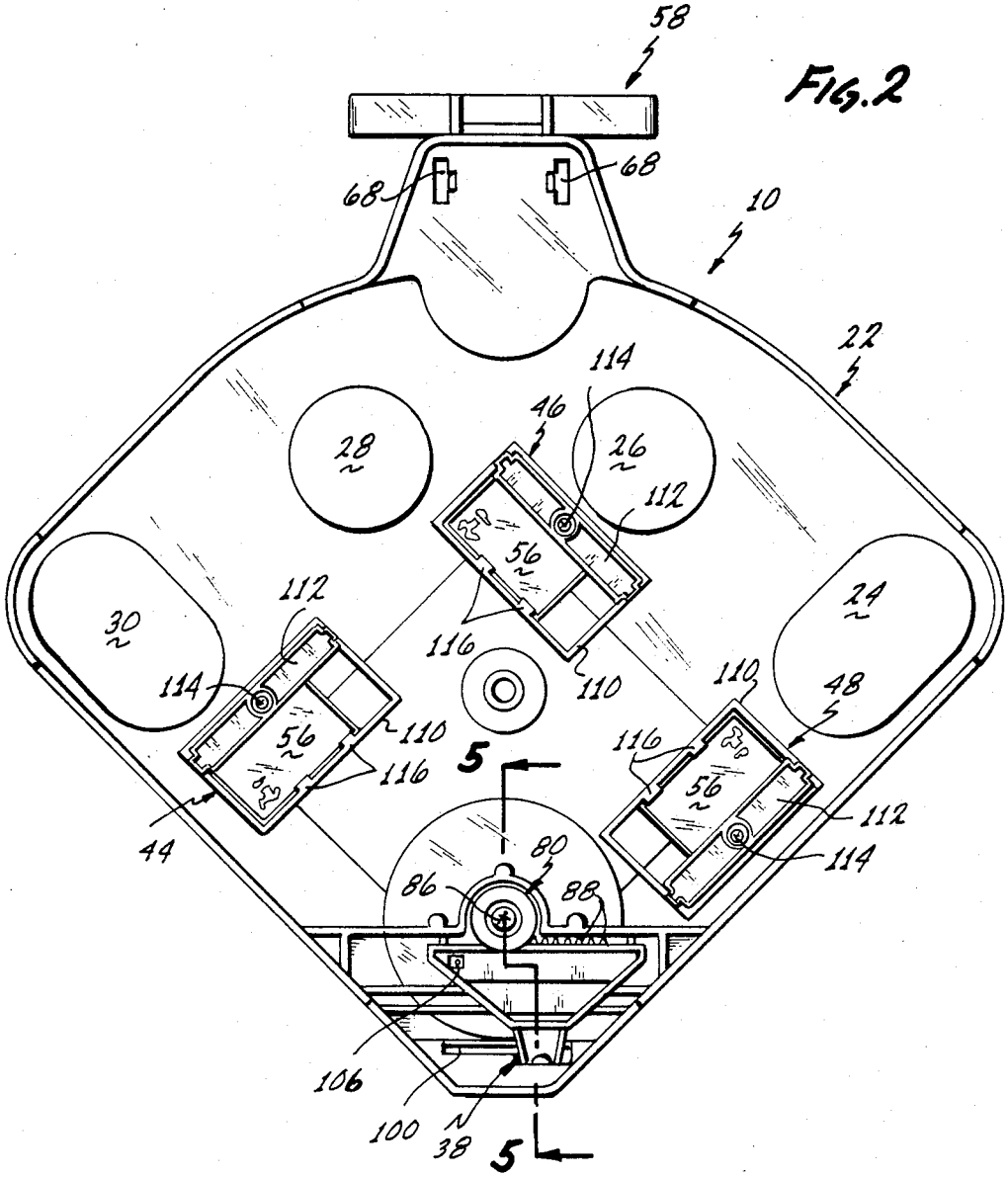
FIG. 2 is a bottom plan view of the toy shown in FIG. 1.

The invention described in this specification and illustrated in the drawings utilizes certain principles and/or concepts as are set forth in the claims appended to this specification. Those skilled in the toy arts will realize that these principles and/or concepts are capable of being utilized in a variety of embodiments differing from the exact illustrative embodiment utilized for illustrative purposes herein. For this reason, this invention is to be construed in light of the claims and is not to be construed as being limited to the exact illustrative embodiment.

DETAILED DESCRIPTION OF THE INVENTION

The toy 10 shown in FIG. 1 is depicted as a miniature baseball game. It includes an object 12 which, for the sake of brevity of this specification, will not be described in great detail. The same has been described in great detail in application Ser. No. 198,799, herein incorporated by reference. At this point, it suffices to say that the object 12 includes a wind-up knob 14, by which a spring motor, not separately identified or numbered, located within the object 12 is wound. When so wound, the spring motor causes the feet 16 of the object 12, which are exposed, to reciprocally move with respect to the remainder of the object 12, that is, the round, ball-like body 18 of the object 12. This causes the object 12 to move in a hopping-like manner over the playing surface 20 of the toy 10.

The playing surface 20 is formed as the upper surface of the housing 22. The housing 22 is molded to include certain surface features which, for the illustrative embodiment, are geared toward the game of baseball, it being realized that other surface features could be utilized which could vary the theme to a different type sporting event or the like.

In any event, for the illustrative embodiment herein, the playing surface 20 includes out depressions 24, 26, 28 and 30. These are depressions formed in the molding of the playing surface 20 and are sized and shaped to be able to contain and retain the object 12 if the object 12 encounters them, and essentially falls into them.

For the theme of the toy 10 illustrated, the depressions 24, 26, 28 and 30 are designated as out depressions, and if the object 12 lands in them, an out is charged against the player who is currently in charge of activating and playing with the object 12.

The spaces between out depression 24 and 26 is designated as a three base hit area 32. The space between out depressions 28 and 30 is depicted as a one base hit area 34. If the object, as hereinafter described, successfully travels to either the area 32 or the area 34, the player so directing the object is credited with either a three base hit or a one base hit, and moves certain indicating devices as hereinafter explained, to credit himself with either the three base or one base hit, as is customary in the game of baseball.

The area between depressions 26 and 28 leads to the home run depression 36. This, in effect, is a shelf, formed on the one corner of the playing surface 20. If the object 12 successfully negotiates travel between the depressions 26 and 28, it leaves the playing surface 20, falling on to the shelf formed by the home run depression 36. At this time, the player so directing the object 12 is credited with a home run, and this is indicated utilizing the indicating devices explained below.

Formed on the corner of the housing 22, near what would constitute the home plate area, is a movable element 38 which the player of the game utilizes to control rotary movement of the home plate member 40. By moving the movable element 38 to the right as seen in FIG. 1, the home plate element 40 is caused to rotate counterclockwise through approximately 270° of rotation. By moving the movable element 38 only a portion of the distance to the right, the home plate member 40 will rotate an increment of the 270°. Thus, it is possible to rotate the home plate member 40 anywhere from 0°, by no movement of the element 38, to 270°, by full movement of the element 38, or any increment in between.

A retaining rib 42 is formed approximately around one half of the home plate member 40. The retaining rib 42 is molded as a part of the housing 22 and extends upwardly from the playing surface 20 a short distance. The retaining rib 42 is utilized to retain further movement of the object 12 toward the element 38 once the object 12 is located on the home plate member 40 and has abutted up against the retaining rib 42.

Located at the first base, second base and third base positions, are indicators 44, 46 and 48, respectively. Each of these indicators are identical in their components and operation and only differ because of their placement on the playing surface 20. Each of the indicators includes a button 50 which projects upwardly in a slot 52 formed in the playing surface 20. Adjacent to the slot 52 is rectangular cutout 54 and located below the rectangular cutout 54 is an indicator plate 56 having an indicia marking thereon. When the button 50 is in the right hand side of the slot 52, as, for instance, with regard to the indicator 44, the indicia located on the indicator plate 56 is hidden. When the button 50 is slid to the left in the slot 52, the indicia on the indicator plate 56 is viewable through the cutout 54. Use of the indicators 44, 46 and 48 are made to keep track of how many times the object 12 successfully is positioned either in the one base hit area 34, the three base hit area 32, or the home run depression 36.

Positioned adjacent to the home run depression 36 is a scoring pedestal 58 which carries two dials 60 and 62 located thereon. Each of the dials 60 and 62 include pointers 64 and 66, respectively. One of the dials 60 or 62 is indicated to be the home players dial and the other is indicated to be the visitor players dial. Each time a run is scored in the normal manner of play of baseball, the pointers 64 or 66 are moved one increment on the dials 60 and 62 to so keep a running track of the runs scored. The dials 60 and 62 have indicia located thereon to indicate appropriate scores such as the numerals 1 through 10 or the like.

The pedestal 58 is hinged to the housing 22 by two small tabs, not seen or numbered, located on the outside surfaces of each of the respective sides of the pedestals, which fit into appropriate holes, not seen or numbered, formed in the two ears, collectively identified by the numeral 68, which project upwardly from the home plate depression area 36. This allows pivoting of the scoring pedestal 58 downwardly to a position over the playing surface 20 for storage purposes of the toy 10 and pivoting to an upright surface during actual play of the toy 10.

The toy 10 is utilized as follows. The object 12 is activated by turning the knob 14 to wind its unseen motor. It is then released somewhere near the second base indicator 46 in a direction heading toward the home plate member 40. As the object 12 moves in a hopping-like motion toward the home plate 40, it may or may not go in a straight line. In any event, when it approaches the home plate member 40, it can be located thereon, and at this time, the player then in charge moves the element 38 a certain amount to the right to rotate the home plate member 40 through a specific number of degrees, to attempt to rotate the direction of travel of the object 12 toward a new point, such as toward the first base or third base areas 34 and 32, or the home run depression 36. In any event, if the object 12 becomes so located on the home plate member 40 and the home plate member 40 is rotated and the object 12 then leaves the surface of the home plate member 40 and repositions itself back on the playing surface 20, it can continue its movement across the playing surface 20, either toward the designated areas previously mentioned, or, to the consternation of the player in charge, may inadvertently land up in one of the out depressions 24, 26, 28 or 30. If the object 12 lands up in one of the out depressions 24, 26, 28 or 30, an out is credited against that player. In the normal manner, when three outs are credited, that particular player's turn and that inning are over, and the next player assumes control of the object 12.

If, in fact, an out is not scored, but, for instance, the object 12 ends up near the one base hit area 34, the player is credited with a base hit and the indicia located on the first base indicator 44 is moved such that it is exposed, indicating that that player now has a man located on first base. The player then once again winds the knob 14 of the object 12 directed toward the home plate member 40, and if it is successfully located on to the home plate member 40, rotates the home plate member 40 by moving the element 38 to the right to once again direct the object 12 back toward the playing surface 20. If the player successfully then positions the object 12 once again in one of the hit areas 32 or 34, or in the home run depression 36, that player is credited with doing so by advancing his man from the first base indicator 44 through the number of spaces indicated, as well as advancing the theoretical man who was at bat and was represented by the object 12 during its last move. Play is continued by the first player until three outs are obtained in the normal manner and a second player then has a turn in attempting to score as many runs as possible in the normal manner in which baseball is played.

The home plate member 40 is composed of a disk 70 having an axle 72 extending from its center. The axle 72 has a flat surface 74 on one side, its use as will be evident below. The axle 72 passes through an opening 76 formed in the bottom of a depression 78 in which the home plate member 40 rests. Depression 78 is molded into the housing 20 during formation of the same.

A pinion 80 has an opening 82 which also has a flat surface 84 and fits over the axle 72. The pinion 80 is retained on the axle 72 via screw 86. Because of the flat surfaces 84 and 74, rotation of the pinion is communicated to the axle 72 and disk 70 such that when the pinion 80 is rotated, the home plate member 40 is rotated.

The element 38 includes a gear rack 88 formed thereon. The gear rack 88 is linear, such that as the element 38 slides back and forth in a linear manner against the housing 22, the gear rack 88 moves linearly.

The element 38 is mounted to the bottom of the housing 22 by passing a portion of the element 38 through a slot 100 formed in the housing 22. The pinion 80 includes a flange 102 which fits over the gear rack 88, and when the pinion 80 is fixedly attached to the axle 72, the flange 102, in combination with the slot 100, holds the element 38 to the bottom of the housing 22.

A spring 104 attaches to a tab 106 formed on the element 38. The other end of the spring 104 attaches to a tab 108 formed on the underneath surface of the housing 22. The spring 104 biases the element 38 to the right as seen in FIG. 1, which in turn biases the home plate member 40 in a clockwise manner to its starting position as seen in FIG. 1. When the element 38 is moved to the right as seen in FIG. 1, this stretches the spring 104 and when the element 38 is released the spring 104 then returns both the element 38 and the home plate 40 to their initial positions.

As seen in FIG. 3, the indicator plates 56 fit within a rectangular shaped rib 110 formed on the underneath side of the housing 22. A bar 112 is fixed to the housing 22 via a screw 114. The rib 110 includes two projections collectively identified by the numeral 116, which, in conjunction with the bar 112, holds the indicator plates 56 against the bottom side of the playing surface 20. The indicator plates 56, however, are free to slide underneath the bar 112 and the projections 116 such that the indicia located thereon can be exposed or hidden through the cutouts 54 located in the playing surface 20. As noted above, each of the indicators 44, 46 or 48 are identically constructed and differ only because of their placement on the housing 22. As such, like numerals are utilized to designate like parts for the indicators 44, 46 and 48.

I claim:

1. In combination with a self-propelled object a toy which comprises:

a housing having a playing surface, said playing surface including a circular depression formed in said playing surface;

a member sized and shaped to fit within said circular depression, said member rotatably mounted on said housing within said circular depression, said member including a member surface, said member surface being aligned with said playing surface and rotatable with respect to said playing surface as said member rotates;

means located on said housing to rotate said member such that said object can move over said playing surface toward and on to said member surface followed by rotation of said member with respect to said playing surface while said object is located on said member surface prior to movement of said object off of said member surface back on to said playing surface;

retaining means positioned on said playing surface in association with said circular depression, said retaining means extending around a portion of the periphery of said circular depression, said retaining means capable of inhibiting movement of said object;

scoring means located on said playing surface, at least a portion of said scoring means comprising a scoring depression formed in said playing surface, said scoring depression sized and shaped to hold said object and being capable of retaining said object if said object moves from said playing surface into said scoring depression.

2. The toy of claim 1 including:

indicating means located on said playing surface and capable of indicating the progress of a game played with said object and said toy.

3. The toy of claim 2 wherein:

said means to rotate said member includes gear train means operatively associated with said member; and further including a movable element mounted on said housing and operatively associated with said gear train means to move said gear train means which in turn moves said member.

4. The toy of claim 3 wherein:

said gear train means includes a rack and pinion means, said pinion means operatively attached to and capable of rotating said member, said rack means operatively attached to and moved by said movable element, said rack means intermeshing with said pinion means to transfer movement of said movable element to said member.

5. The toy of claim 4 wherein:

said movable element is slidably mounted on said housing to move from an initial position to a second position and further including biasing means biasing said element towards said initial position.

6. The toy of claim 1 wherein:

said means to rotate said member includes gear train means operatively associated with said member; and further including a movable element mounted on said housing and operatively associated with said gear train means to move said gear train means which in turn moves said member.

7. The toy of claim 6 wherein:

said gear train means includes a rack and pinion means, said pinion means operatively attached to and capable of rotating said member, said rack means operatively attached to and moved by said movable element, said rack means intermeshing with said pinion means to transfer movement of said movable element to said member.

8. The toy of claim 7 wherein:

said element is slidably mounted on said housing to move from an initial position to a second position and further including biasing means biasing said element towards said initial position.

* * * * *